US009841164B2

(12) United States Patent
Appelhans et al.

(10) Patent No.: US 9,841,164 B2
(45) Date of Patent: Dec. 12, 2017

(54) TWISTED DOWNLIGHT REFLECTORS

(71) Applicant: BEGA Gantenbrink-Leuchten KG, Menden (DE)

(72) Inventors: Simon Appelhans, Sundern (DE); Heinrich J. Gantenbrink, Menden (DE)

(73) Assignee: BEGA GANTENBRINK-LEUCHTEN KG, Menden (DE)

( * ) Notice: Subject to any disclaimer, the term of this patent is extended or adjusted under 35 U.S.C. 154(b) by 0 days.

(21) Appl. No.: 15/094,149

(22) Filed: Apr. 8, 2016

(65) Prior Publication Data

US 2016/0327243 A1 Nov. 10, 2016

(30) Foreign Application Priority Data

May 6, 2015 (EP) ..... 15001354

(51) Int. Cl.

| | |
|---|---|
| ***F21V 7/00*** | (2006.01) |
| ***F21V 7/04*** | (2006.01) |
| ***F21V 3/04*** | (2006.01) |
| ***F21V 7/06*** | (2006.01) |
| ***F21V 7/09*** | (2006.01) |
| *F21Y 101/02* | (2006.01) |
| *F21Y 101/00* | (2016.01) |

(52) U.S. Cl.

CPC ..... *F21V 7/04* (2013.01); *F21V 3/0427* (2013.01); *F21V 7/0066* (2013.01); *F21V 7/046* (2013.01); *F21V 7/06* (2013.01); *F21V 7/09* (2013.01); *F21Y 2101/00* (2013.01); *F21Y 2101/02* (2013.01)

(58) Field of Classification Search

USPC ..... 362/297

See application file for complete search history.

(56) References Cited

U.S. PATENT DOCUMENTS 7,441,927 B1 * 10/2008 Kling ..... F21V 5/00 362/297

FOREIGN PATENT DOCUMENTS

| | | |
|---|---|---|
| DE | 691 30 738 T2 | 9/1999 |
| DE | 699 35 381 T2 | 7/2007 |
| EP | 0 915 287 A2 | 5/1999 |
| EP | 2 535 639 A1 | 12/2012 |

* cited by examiner

*Primary Examiner* — Rafferty Kelly

(74) *Attorney, Agent, or Firm* — Baker and Hostetler LLP

(57) ABSTRACT

A generic reflector comprises a light inlet end, a light outlet end with at least one substantially rectangular light outlet opening, an optical axis, and a reflector surface which extends between the light inlet end and the light outlet end, where the reflector surface in a plane perpendicular to the optical axis defines a polygon. The reflector surface is formed such that the polygon between the light inlet end and the light outlet end at least in sections rotates about an axis of rotation which is oriented parallel to the optical axis. The invention also relates to an arrangement comprising at least two reflectors and a luminaire with a reflector and a light source, comprising an LED.

13 Claims, 6 Drawing Sheets

TWISTED DOWNLIGHT REFLECTORS

CROSS-REFERENCE TO RELATED APPLICATION

This application claims priority to foreign European patent application No. 15001354.8, filed on May 6, 2015, the disclosure of which is incorporated by reference in its entirety.

FIELD OF THE INVENTION

The present invention relates to a reflector for a luminaire, in particular for a luminaire with at least one LED light source, according to the preamble of claim 1. According thereto, a generic reflector comprises a light inlet end, a light outlet end with at least one substantially rectangular light outlet opening, an optical axis, and a reflector surface which extends between the light inlet end and the light outlet end, where the reflector surface in a plane perpendicular to the optical axis defines a polygon.

Generic reflectors are used inter alia in recessed downlights, but also in other luminaires. The light outlet opening is typically aligned to be concentric to the optical axis of the reflector and the optical axis is surrounded substantially entirely by the reflector surface. Reflectors are often used in particular with a rectangular reflector surface, where the four side surfaces of the reflector are in the direction between the light inlet end and the light outlet end formed in a curved manner, in particular in a parabolic manner.

However, one drawback of the generic reflectors is that the reflector surface does not transition continuously into each other at the corners of the cross-sectional surface. In generic reflectors, the angle between the partial surfaces of the reflector surface is 90°. This leads to inhomogeneities in the luminance intensity in the light cone emitted. The light cone emitted ideally exhibits uniform luminance intensity with sharp edges, where the shape of the light cone corresponds substantially to the shape of the reflector surface if no aperture is disposed at the light outlet end of the reflector or in the direction of the light cone emitted. The inhomogeneities caused by the edges now have the effect that the light cone emitted exhibits no uniform luminance intensity, but areas of increased or reduced luminance intensity.

These drawbacks are particularly apparent with LED's as light sources because the projection properties of the reflectors have a greater impact on the light cone emitted when using these quasi point-shaped light sources. Generic reflectors for this reason exhibit significant inhomogeneities when using LED's.

SUMMARY OF THE INVENTION

It is therefore an object of the present invention to provide a reflector of the kind mentioned whose light cone emitted comprises a more homogeneous luminance intensity.

The object is satisfied by the features of claim 1. Accordingly, a reflector of the kind mentioned above then satisfies the object of the invention where the reflector surface is formed such that the polygon between the light inlet end and the light outlet end at least in sections rotates about an axis of rotation which is oriented parallel to the optical axis.

The invention offers the advantage that a twisted rotational surface arises due to the rotating polygon. The inhomogeneities created along the edge thereby no longer overlap in one area of the light cone emitted, but are spread over several directions of projection and overlap with light beams that have been reflected at a distance from the edges of the reflector surface. The luminance intensity of the light cone emitted is overall more homogeneous.

Since reflectors commonly taper towards the light inlet end, it is within the scope of the present invention apparently possible that the polygon also changes its shape and size between the light inlet end and the light outlet end. The corners of the rotating polygon there define spirals on the reflector surface.

In one embodiment, the polygon comprises more than four corners, and a first transition region is formed at the light outlet end in which the polygon transitions continuously to the shape of the light outlet opening. By increasing the number of corners, the angle between two adjacent surface portions increases, which leads to a reduction in the level of inhomogeneity of a corner. In the first transition region, the polygon can further rotate about the axis of rotation.

Since the optical axis and the axis of rotation are parallel, and the plane of the polygon is perpendicular to the optical axis, also the axis of rotation is perpendicular to the plane of the polygon.

In one embodiment of the present invention, the reflector surface is a reflective coating of a reflector shell. However, is alternatively also possible that the reflector shell is made of reflective material and its inner surface facing the optical axis is formed as a reflector surface.

In a further embodiment of the present invention, the axis of rotation and the optical axis coincide. Symmetric light cone shapes can thereby be realized in a particularly simple manner. It is alternatively conceivable, however, that the axis of rotation and the optical axis do not coincide in order to achieve other light cone shapes.

In a further embodiment of the reflector according to the invention, the light outlet opening is square. However, it is alternatively also conceivable that the light outlet opening has a different rectangular shape.

In the context of the present invention, the rectangular light outlet opening can have curved edges. This allows adapting the reflector to lighting tasks or design aspects.

The present invention further provides an arrangement with at least two reflectors according to the invention, where the light outlet openings of the reflectors are disposed adjacently and the rotations of the polygons of adjacent reflectors have an opposite direction of rotation.

The invention further provides a luminaire with a reflector according to the invention and a light source, where the light source is arranged at the light inlet end of the reflector and comprises at least one LED. The reflector according to the invention is particularly advantageous for luminaires with LED's.

Advantageous embodiments of the present invention are the subject matter of the dependent claims.

In a preferred embodiment, the edges of the polygon are formed in a curved manner. This allows adapting the reflector in a simple manner to lighting tasks or design aspects. The edges are in particular curved convexly. This can further improve the projection properties of the reflector. In this embodiment, also the outer side of the reflector shell can be formed in a curved manner, in particular be convex.

In a further preferred embodiment, the polygon is a point-symmetrical polygon, and the center of symmetry is located on the axis of rotation. Accordingly, the polygon rotates about its center of symmetry. Particularly symmetric light cone shapes can thereby be realized in a simple manner.

In a particularly preferred embodiment, the polygon is a point-symmetrical octagon with a 4-fold rotational symmetry. In this embodiment, already a smaller rotational angle has a particularly advantageous effect upon the homogeneity of the luminance intensity, where the manufacturing cost and the number of discontinuities in the reflector surface are at the same time kept to be small.

Very particularly preferably, four of the eight corners of the octagon open to the corners of the rectangle of the light outlet opening, and the remaining four corners of the octagon to the centers of the edges of the square of the light outlet opening, where the corners of the octagon alternately open to the corners and to the centers of the edges of the light outlet opening.

In a further preferred embodiment, the polygon rotates along the entire reflector surface between the light inlet end and the light outlet end. In this embodiment, the rotation of the polygon is particularly effective for the homogeneity of the luminance intensity of the light cone emitted. If the reflector comprises a first transition region at the light outlet end, then the polygon can rotate up to the beginning of the transition region or even within the transition region up to the light outlet end.

In a further preferred embodiment, the rotational angle swept through by a corner of the polygon in a plane perpendicular to the axis of rotation due to the rotation between the light inlet end and the light outlet end is greater than 15°. From this rotational angle, the rotation has a particularly advantageous effect on the homogeneity of the luminance intensity.

In a further preferred embodiment, the rotational angle of each corner is substantially 360° divided by the number of corners of the polygon. In this embodiment, the inhomogeneities of a corner are distributed over a region extending up to the point of origin of the inhomogeneity effected by the next corner. Therefore, no more inhomogeneities exist for this rotational angle.

In a further preferred embodiment, the reflector surface is formed in a parabolic manner in a plane parallel to the optical axis between the light inlet end and the light outlet end. In this embodiment, the reflector additionally comprises the light-refracting properties of a parabolic mirror. In this embodiment, parallel light cones can be realized in a particularly easy manner.

In a further preferred embodiment, the reflector comprises a light inlet opening at the light inlet end. Through the light inlet opening, a light source can in a particularly simple manner be arranged in the reflector, or light can in a particularly easy manner be entered into the reflector.

In a further preferred embodiment, the reflector is flattened at the light inlet end and the reflector surface at the flattened light inlet end opens to a base area. This makes the reflector be very compact. The base area being formed by the flattened end and opening to the reflector surface can there have the shape of the polygon. Most preferably, the base area and the plane spanned by the light outlet opening are parallel.

In a further very particularly preferred embodiment, the base area is formed to be substantially rectangular, and a second transition region is formed at the light inlet end in which the polygon transitions continuously to the shape of the base area. Inhomogeneities in the light cone emitted caused by edges can thereby be prevented. The shape of the base area can in particular have curved edges and/or the shape of the light outlet opening. This results in a particularly aesthetic overall impression. In this embodiment, the polygon can in the first transition region further rotate about the axis of rotation.

In a preferred embodiment, the light outlet opening and the base area are formed substantially square-shaped, and the polygon is a point-symmetrical octagon with a 4-fold rotational symmetry, where the reflector surface is designed such that it extends parabolically in a plane parallel to the optical axis between the light inlet end and the light outlet end, and the polygon rotates between the base area and the light outlet opening along the entire reflector surface such that the corners of the base area transition to those corners of the octagon which open to the centers of the edges of the light outlet opening, and the centers of the edges of the base area transition to those corners of the octagon which open to the corners of the light outlet opening. This embodiment results in improved luminance intensity regardless of the height of the reflector. In addition, a good aesthetic overall impression arises.

In this embodiment, two different spiral shapes are defined on the reflector surface by the corners of the rotating octagon, where the first spirals extend from the centers of the corners of the base area to the centers of the edges of the light outlet opening and the second spirals from the centers of the edges of the base area to the corners of the light outlet opening.

In a particularly preferred embodiment, the edges of the base area and the edges of the light outlet opening are aligned parallel to each other. This results in a particularly aesthetic reflector.

In a further preferred embodiment, the reflector is produced by way of injection-molding. The reflector according to the invention can thereby be produced in a particularly easy manner.

In a particularly preferred embodiment, the reflector shell is at least in part formed in a convex manner. This facilitates demolding the reflector during injection-molding.

Very particularly preferably, a first reflector body is first manufactured by way of injection-molding and a reflective coating is then applied on the inner side of the reflector shell for forming the reflector surface. The reflector according to the invention can with this method be produced in a particularly easy and inexpensive manner.

In a particularly preferred arrangement, the arrangement comprises four reflectors being disposed in a rectangle, where the oppositely disposed reflectors are of identical design. Overlapping of the homogenous light cones of the individual reflectors according to the invention results in a particularly homogeneously emitted light bundle for the entire arrangement.

In a preferred embodiment of the luminaire, the luminaire comprises a diffuser element. The diffuser element can be formed, for example, as a cover glass and be arranged at the light outlet opening. The luminance intensity of the light cone emitted can thereby be further homogenized.

BRIEF DESCRIPTION OF THE DRAWINGS

An embodiment of the present invention is explained in more detail below with reference to drawings, where.

DETAILED DESCRIPTION

Figure 1:
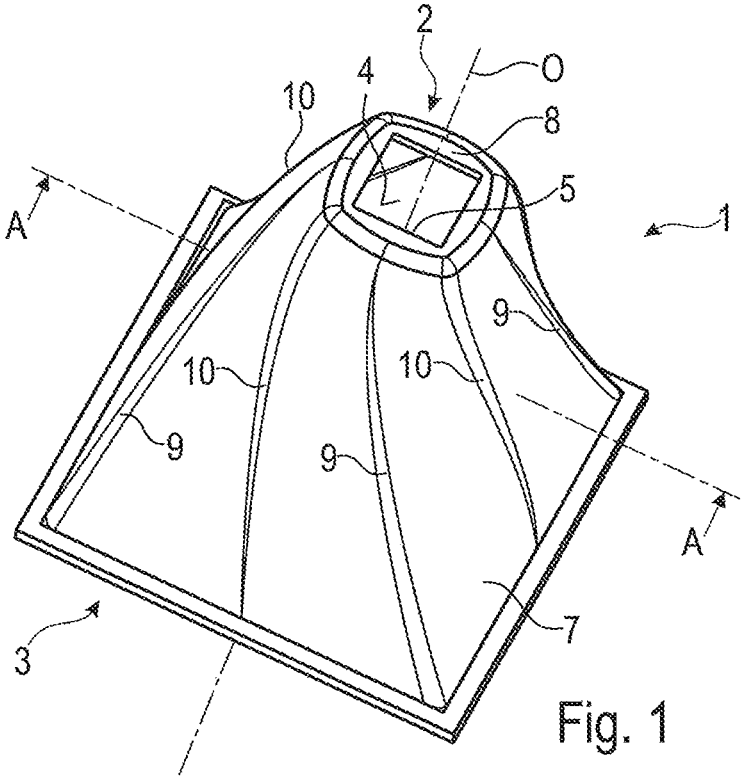
FIG. 1: shows a schematic representation of a reflector according to the invention in perspective.

It applies for the following explanations same components are denoted by same reference numerals in the event that a drawing contains reference numerals which are not explained in more detail in the accompanying figure description, then reference is made to preceding or subsequent figure descriptions.

Figure 2:
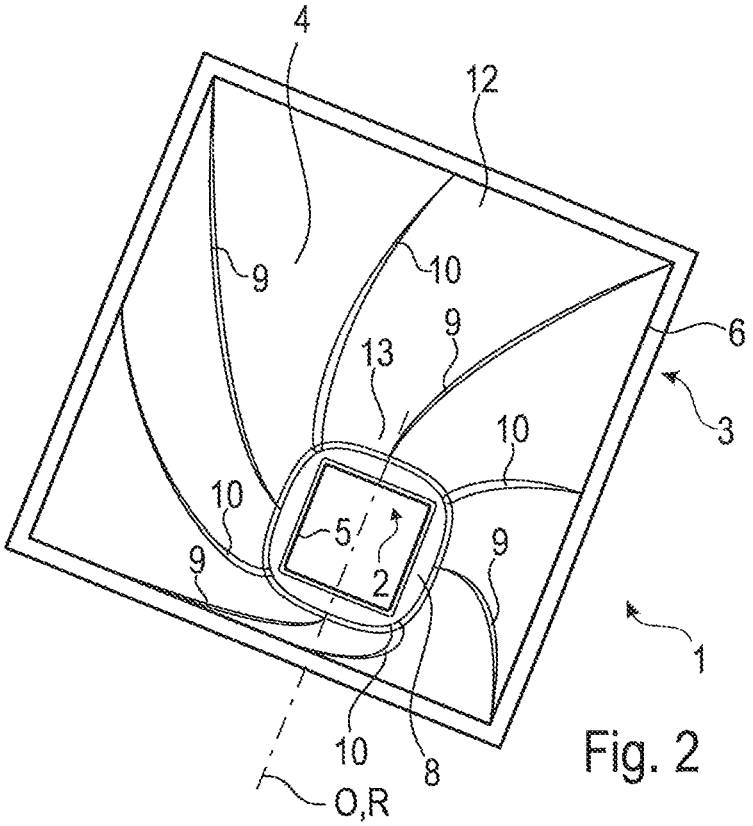
FIG. 2: shows a further representation of the reflector of FIG. 1 in perspective.

FIGS. 1 and 2 show a reflector 1 according to the invention with a light inlet end 2, a light outlet end 3 and a reflector shell 7 which extends between light inlet end 2 and light outlet end 3. A light outlet opening 6 is formed at light outlet end 3. Reflector surface 4 is formed on the inner side of reflector shell 7. The reflector comprises a flattened light inlet end 2 with a base area 8. Base area 8 is square, where the edges are formed in a convex manner. A light inlet opening 5 is formed at base area 8. Reflector surface 4 surrounds optical axis O of reflector 1. In the embodiment illustrated, light inlet opening 5 and light outlet opening 6 are formed to be square and are oriented to be coaxial relative to optical axis O and parallel to each other.

Reflector 1 was produced by way of an injection-molding process, where a reflector body comprising reflector shell 7 is first produced and reflector surface 4 is then applied as a reflective coating on the inner side of reflector shell 7. In order to facilitate demolding of reflector 1 during injection-molding, the outer side of reflector shell 7 is formed to be convex. The outer side there follows the curvature of reflector surface 4, so that reflector shell 7 has a substantially uniform wall thickness.

It is in FIG. 2 shown that reflector surface 4 defines an octagon. Reflector surface 4 at light outlet end 3 comprises a first transition region 12, and at light inlet end 3 a second transition region 13. In transition regions 12, 13, octagon 11 transitions continuously to the shape of light inlet opening 5 or light outlet opening 6, respectively. Octagon 11 rotates along the entire reflector surface 4 between light inlet end 2 and light outlet end 3 about an axis of rotation R, where axis of rotation R coincides with optical axis O. Octagon 11 also rotates within first transition region 12 and second transition region 13. The edges of rotating octagon 11 define spirals 9, 10 on reflector shell 7 and on reflector surface 4. In the illustrated embodiment, the entire angel of rotation of all corners $\alpha$ is 45°. The angle of rotation of each corner is therefore greater than 15° and corresponds to 360° divided by the number of corners.

Spirals 9 each extend from a center of the edges of base area 8 to a respective corner of light outlet opening 6. Spirals 10 each extend from a corner of base area 8 to a respective center of the edges of light outlet opening 6.

Figure 3:
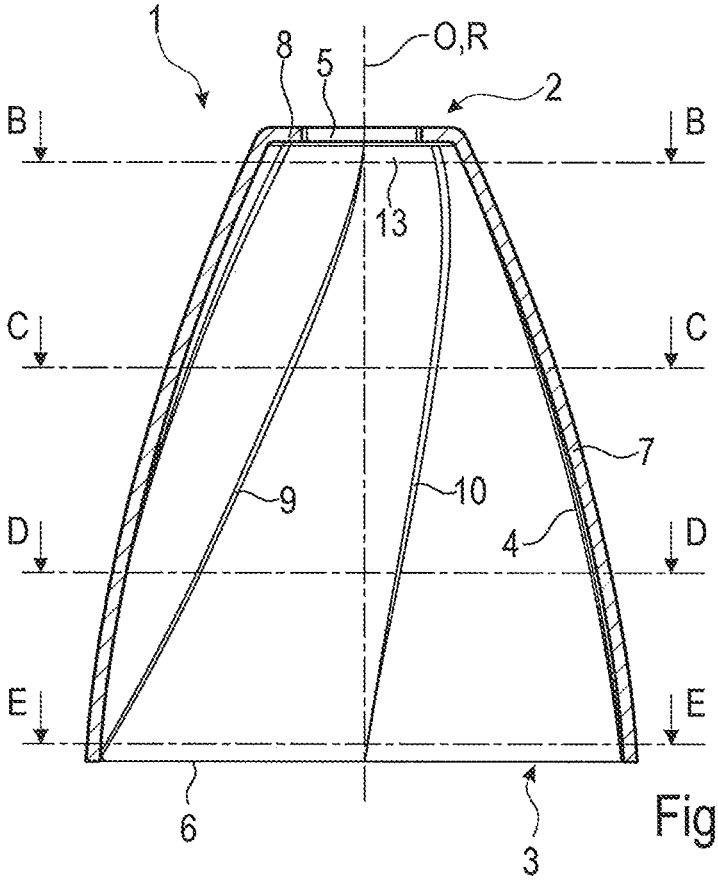
FIG. 3: shows the reflector of FIG. 1 in cross section along section line A.

FIG. 3 shows the reflector of FIG. 1 in cross section along section line A. Reflector surface 4 is in the embodiment shown formed in a parabolic manner. Base area 8 and light outlet opening 6 are parallel to each other.

Figure 4:
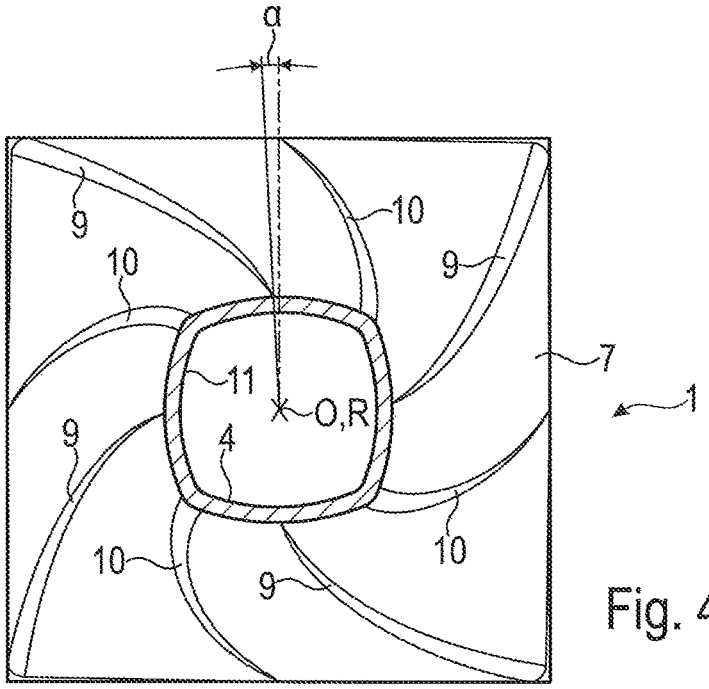
FIG. 4: shows the reflector of FIG. 3 in cross section along section line B.

FIG. 4 shows second transition region 13 of reflector 1 of FIG. 3 in a sectional view along axis B. Octagon 11 has almost completely transitioned to the shape of base area 8, and in relation to base area 8 has a small rotational angle $\alpha$ of about 5° about axis of rotation R.

Figure 5:
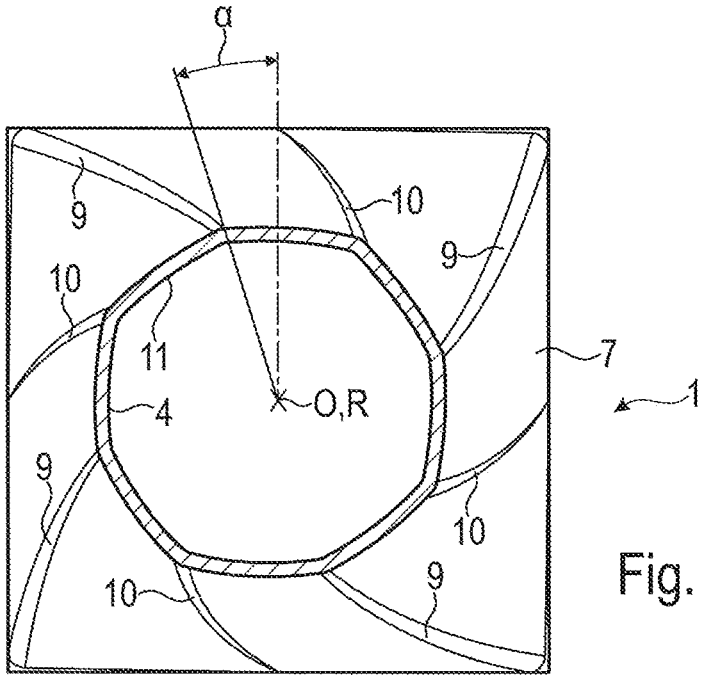
FIG. 5: shows the reflector of FIG. 3 in cross section along section line C.

FIG. 5 shows the reflector of FIG. 3 along section line C. Polygon 11 being defined by reflector surface 4 is a point-symmetrical octagon 11 with a 4-fold rotational symmetry rotating about its center of symmetry. The edges of octagon 11 are formed in a convex manner.

Figure 6:
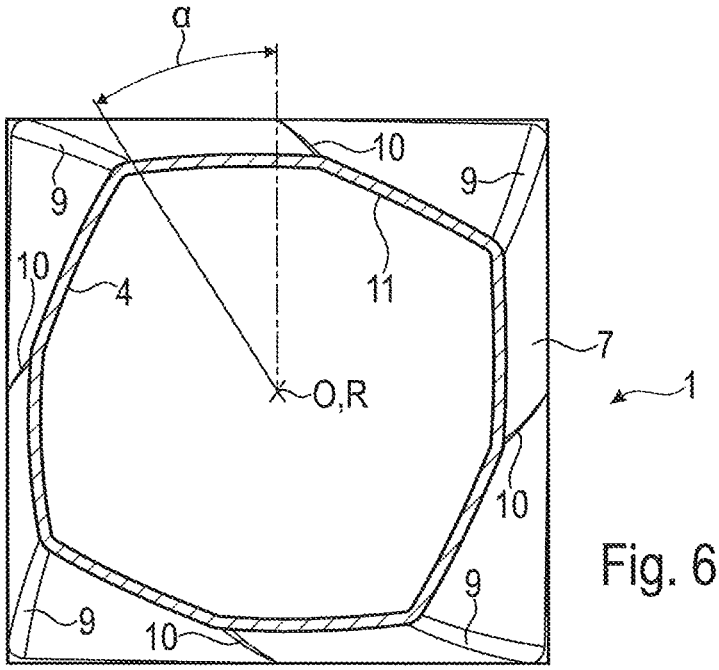
FIG. 6: shows the reflector of FIG. 3 in cross section along section line D.

FIG. 6 shows the reflector of FIG. 3 along section line D. Octagon 11 is further point-symmetrical and has a 4-fold rotational symmetry. However, it has slightly changed the shape of octagon 11 since the corners defining spirals 9 for reaching the corners of light outlet opening 5 must travel a greater distance than the corners defining spirals 10. The rotational angle $\alpha$ is now about 30°.

Figure 7:
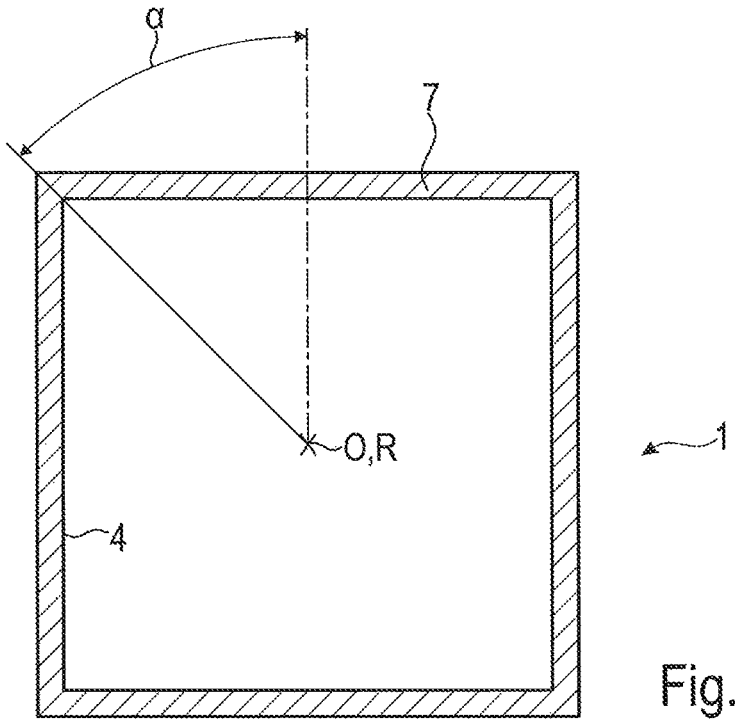
FIG. 7: shows the reflector of FIG. 3 in cross section along section line E.

FIG. 7 shows first transition region 12 of the reflector of FIG. 3 along section line E. Octagon 11 further rotates and has almost entirely transitioned to the shape of the light outlet opening. The rotational angle $\alpha$ is now about 45°.

Figure 8:
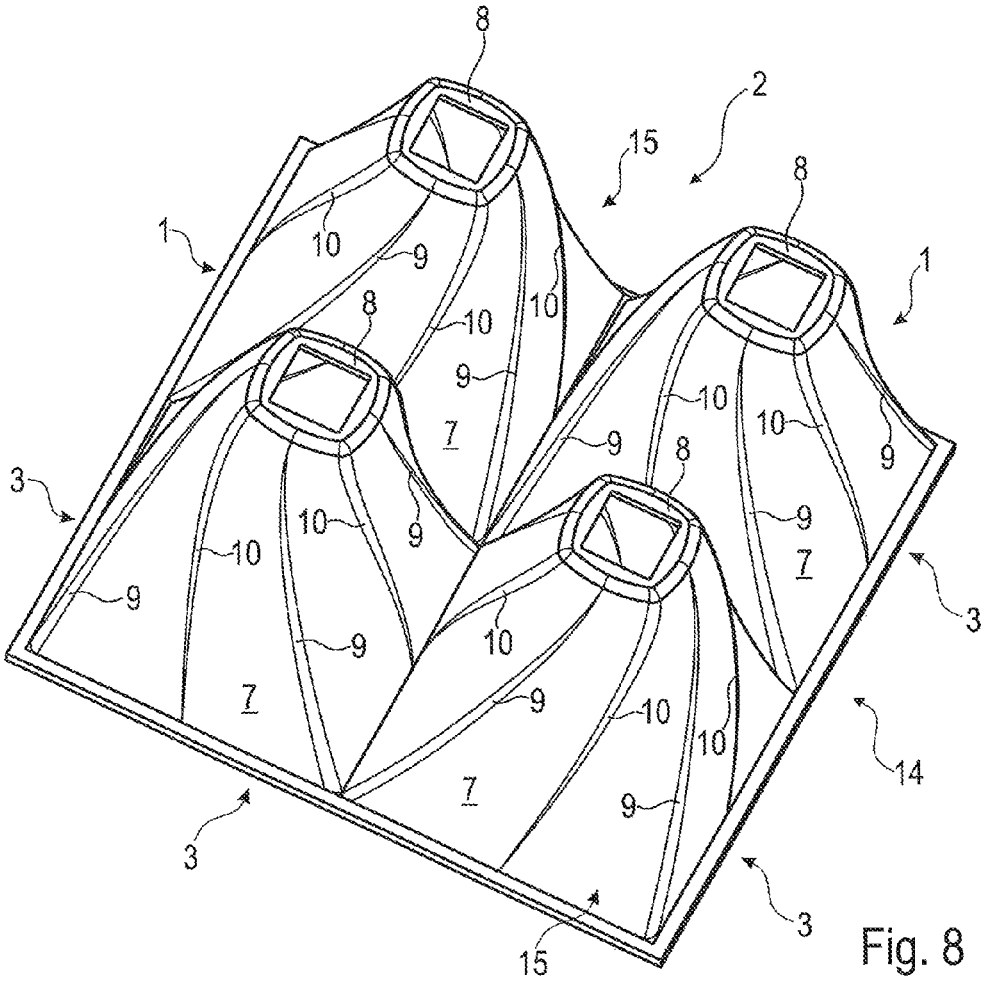
FIG. 8: shows an arrangement of four reflectors according to the invention in perspective
Figure 9:
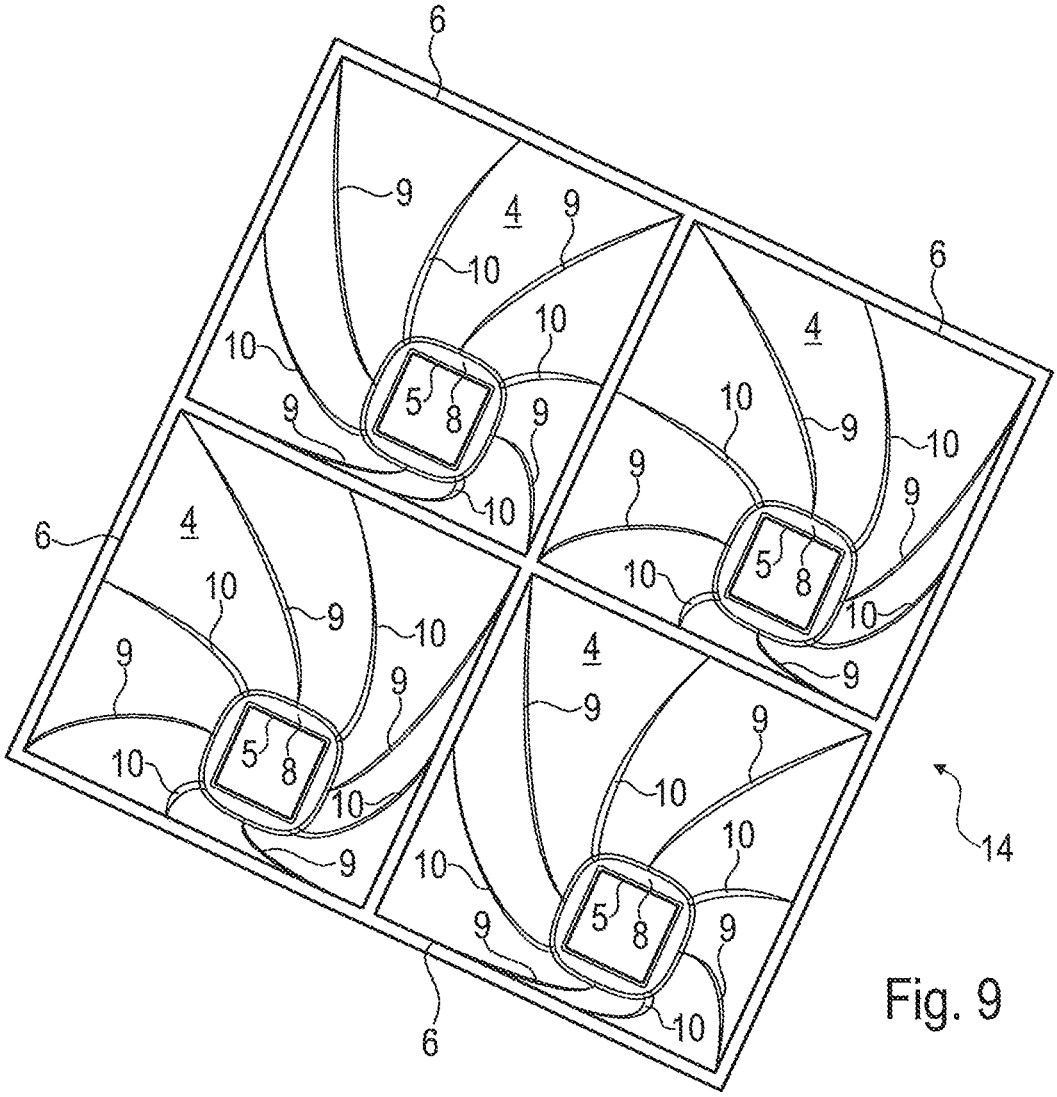
FIG. 9: shows a further representation of the arrangement in FIG. 8 in perspective.

FIGS. 8 and 9 show an arrangement 14 of 4 reflectors 1, 15, where reflectors 15 correspond to the reflector of FIGS. 1-7, but have an opposite direction of rotation. The 4 light inlet ducks 3 [sic] are located adjacently in one plane.

The invention claimed is:

1. A reflector for a luminaire, in particular for a luminaire with at least one LED light source, comprising a light inlet end, a light outlet end with at least one substantially rectangular light outlet opening, an optical axis, and a reflector surface which extends between said light inlet end and said light outlet end, where said reflector surface at least in sections in a plane perpendicular to said optical axis defines a polygon, wherein said reflector surface is formed such that said polygon between said light inlet end and said light outlet end at least in sections rotates about an axis of rotation which is oriented parallel to said optical axis, wherein said reflector is flattened at said light inlet end and said reflector surface at said flattened light inlet end opens to a base area, and wherein said light outlet opening and said base area are formed substantially square-shaped, and said polygon is a point-symmetrical octagon with a 4-fold rotational symmetry, where said reflector surface is designed such that it extends parabolically in a plane parallel to said optical axis between said light inlet end and said light outlet end, and said polygon rotates between said base area and said light outlet opening along said entire reflector surface such that the corners of said base area transition to those corners of the octagon which open to the centers of said edges of said light outlet opening, and the centers of said edges of said base area transition to those corners of said octagon which open to the corners of said light outlet opening.

2. The reflector according to claim 1, wherein the edges of said polygon are formed in a curved manner.

3. The reflector according to claim 1, wherein said polygon is point-symmetric and the center of symmetry is located on said axis of rotation.

4. The reflector according to claim 3, wherein said polygon is a point-symmetrical octagon with a 4-fold rotational symmetry.

5. The reflector according to claim 1, wherein said polygon rotates along said entire reflector surface between said light inlet end and said light outlet end.

6. The reflector according to claim 1, wherein said rotational angle swept through by a corner of said polygon in a plane perpendicular to said axis of rotation due to the rotation between said light inlet end and said light outlet end is greater than 15.degree.

7. The reflector according to claim 1, wherein said rotational angle of each corner is substantially 360.degree. divided by the number of corners of said polygon.

8. The reflector according to claim 1, wherein said reflector surface is formed in a parabolic manner in a plane parallel to said optical axis between said light inlet end and said light outlet end.

9. The reflector according to claim 1, wherein said reflector comprises a light inlet opening at said light inlet end.

10. The reflector according to claim 1, wherein said base area is formed to be substantially rectangular, and a second transition region is formed at said light inlet end in which said polygon transitions continuously to the shape of said base area.

11. The reflector according to claim 1, wherein said reflector is produced by way of injection-molding.

12. An arrangement comprising at least two reflectors according to claim 1, wherein said light outlet openings of said reflectors are disposed adjacently and the rotations of said polygons of adjacent reflectors have an opposite direction of rotation.

13. A luminaire with a reflector and a light source, wherein said reflector is formed according to claim 1, and said light source is disposed at said light outlet opening of said reflector and comprises at least one LED.

* * * * *